US005281186A

United States Patent [19]

Buckley et al.

[11] Patent Number: 5,281,186

[45] Date of Patent: Jan. 25, 1994

[54] PROTECTIVE BREAST CUP ARRANGEMENT

[76] Inventors: Caroline M. Buckley; Robert W. Buckley, Jr., both of P.O. Box 927, Plaistow, N.H. 03865

[21] Appl. No.: 9,059

[22] Filed: Jan. 26, 1993

[51] Int. Cl.[5] ..... A41C 3/12; A41C 3/14

[52] U.S. Cl. ..... 450/31; 450/32; 450/38; 450/57; 604/346; 604/347; 2/73; 2/267

[58] Field of Search ..... 2/1, 2, 73, 67, 104, 2/267, 268; 450/1, 30, 31, 32, 37, 38, 39, 40, 53, 54, 55, 56, 57; 604/346, 347, 358

[56] References Cited

U.S. PATENT DOCUMENTS

| | | | |
|---|---|---|---|
| 2,429,680 | 10/1947 | Goddard | 450/39 |
| 2,440,466 | 4/1948 | Freedman | 450/55 |
| 2,579,365 | 12/1951 | Condé | 450/39 |
| 3,814,101 | 6/1974 | Kozak | 604/370 |
| 3,896,807 | 7/1975 | Buchalter | 604/303 X |
| 4,607,640 | 8/1986 | McCusker | 450/1 |
| 4,700,699 | 10/1987 | Tollerud et al. | 604/358 |
| 5,022,887 | 6/1991 | Lawson | 450/1 |
| 5,032,103 | 7/1991 | Larsson | 450/37 |

FOREIGN PATENT DOCUMENTS

| | | | |
|---|---|---|---|
| 5024498 | 5/1954 | Canada | 450/39 |

*Primary Examiner*—Clifford D. Crowder
*Assistant Examiner*—Jeanette E. Chapman
*Attorney, Agent, or Firm*—Leon Gilden

[57] ABSTRACT

A protective breast cup arrangement wherein at least one breast cup member formed of a rigid cup-shaped construction includes a matrix of apertures directed therethrough, with the breast cup having an annular rim orthogonally oriented relative to a cup axis, with the rim including a continuous cushion member secured coextensively to an exterior surface of the rim to afford cushioning and frictional engagement about an individual's breast.

2 Claims, 4 Drawing Sheets

FIG 1
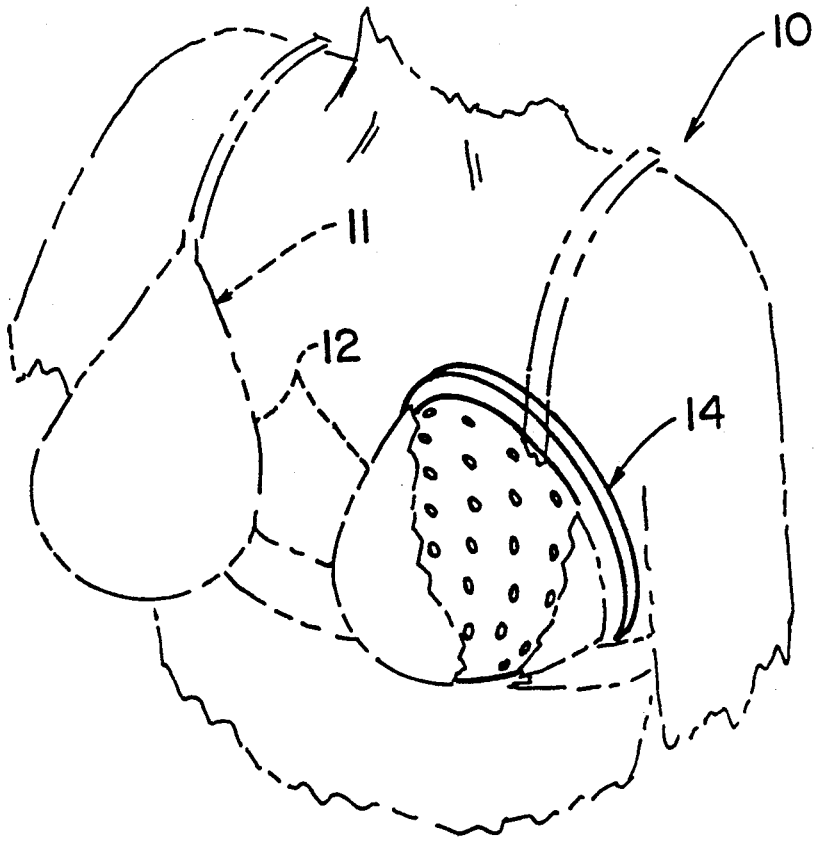
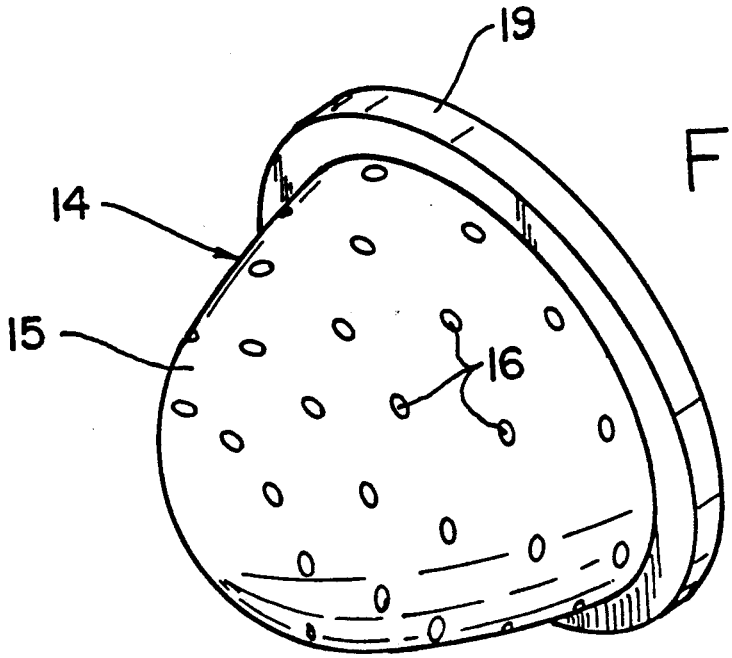
FIG 2

PROTECTIVE BREAST CUP ARRANGEMENT

BACKGROUND OF THE INVENTION

1. Field of the Invention

The field of invention relates to protective cup structure, and more particularly pertains to a new and improved protective breast cup arrangement wherein the same is arranged to afford protection relative to impact relative to an individual's breast.

2. Description of the Prior Art

Protective gear is available in the prior art for protection to women such as those engaged in sporting events, wherein undesired impact to such a woman's breast effects injury and pain, wherein the cup structure of the invention is arranged to afford a cup structure affording ventilation, as well as protection to the individual's breast members and in this respect, the present invention substantially fulfills this need.

SUMMARY OF THE INVENTION

In view of the foregoing disadvantages inherent in the known types of protective cup structure now present in the prior art, the present invention provides a protective breast cup arrangement wherein the same utilizes a plurality of breast cup members arranges to afford protection to an individual's breast region. As such, the general purpose of the present invention, which will be described subsequently in greater detail, is to provide a new and improved protective breast cup arrangement which has all the advantages of the prior art protective cup structure and none of the disadvantages.

To attain this, the present invention provides a protective breast cup arrangement wherein at least on breast cup member formed of a rigid cup-shaped construction includes a matrix of apertures directed therethrough, with the breast cup having an annular rim orthogonally oriented relative to a cup axis, with the rim including a continuous cushion member secured coextensively to an exterior surface of the rim to afford cushioning and frictional engagement about an individual's breast.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protective breast cup arrangement which has all the advantages of the prior art protective cup structure and none of the disadvantages.

It is another object of the present invention to provide a new and improved protective breast cup arrangement which may be easily and efficiently manufactured and marketed.

It is a further object of the present invention to provide a new and improved protective breast cup arrangement which is of a durable and reliable construction.

An even further object of the present invention is to provide a new and improved protective breast cup arrangement which is susceptible of a low cost of manufacture with regard to both materials and labor, and which accordingly is then susceptible of low prices of sale to the consuming public, thereby making such protective breast cup arrangements economically available to the buying public.

Still yet another object of the present invention is to provide a new and improved protective breast cup arrangement which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the invention in use.

FIG. 2 is an enlarged isometric illustration of the individual breast cup structure.

DESCRIPTION OF THE PREFERRED EMBODIMENT

Figure 3:
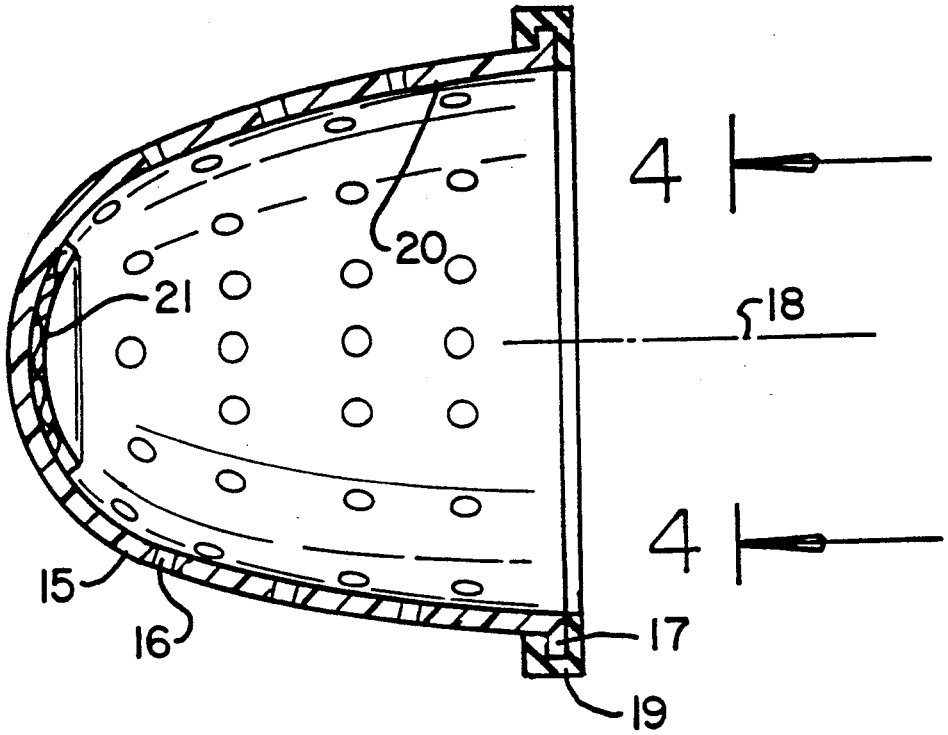
FIG. 3 is an orthographic cross-sectional illustration of the breast cup structure.
Figure 4:
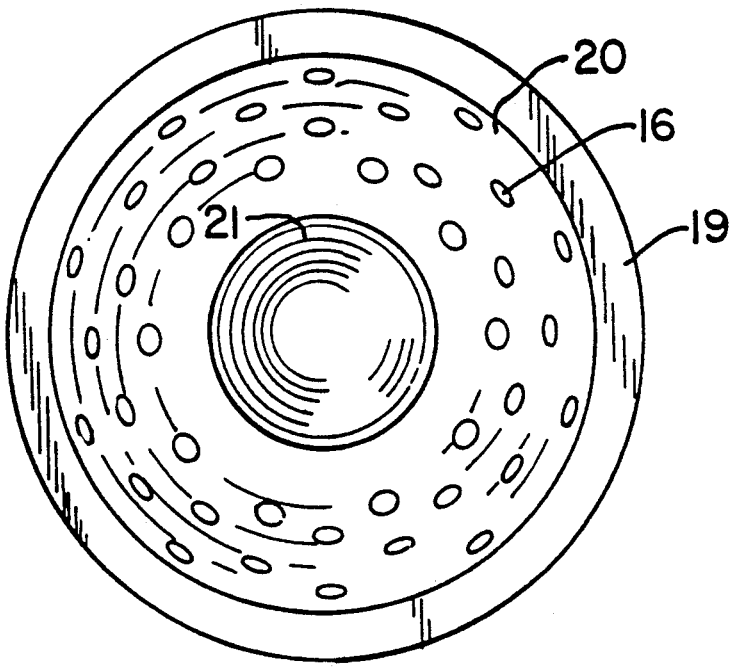
FIG. 4 is an orthographic view, taken along the lines 4—4 of FIG. 3 in the direction indicated by the arrows.

With reference now to the drawings, and in particular to FIGS. 1 to 7 thereof, a new and improved protective breast cup arrangement embodying the principles and concepts of the present invention and generally designated by the reference numeral 10 will be described.

More specifically, the protective breast cup arrangement 10 of the instant invention essentially comprises a brassiere member 11 to include brassiere cup members 12, having cup member connecting web structure extending therebetween. Each brassiere cup member 12 includes an insertable breast cup 14 formed of a rigid cup member 15, having a matrix of apertures 16 directed therethrough. The cup member 15 is symmetrically oriented about a cup axis 18 (see FIG. 3). The cup member includes a cup annular rim 17 integrally mounted relative to the cup member 15 projecting exteriorly thereof, with the rim 17 orthogonally oriented relative to the cup axis 18. A continuous cushion member 19 is mounted to the cup annular rim 17 secured to the cup annular rim and projecting laterally beyond the rim 17 to afford protection to an individual's torso in contiguous communication of the continuous cushion member 19 against the torso portion of an individual. The cup member 15 includes an interior wall surface 20, with a nipple pad 21 mounted to the interior wall surface 20 at a distal end relative to the annular rim 17, with the nipple pad 21 formed of a lotion impregnated fluid absorbent sponge material. Lotion of any type as is commercially available to afford protection and healing to an individual's skin portion, and more particularly to the nipple portion, is provided.

Figure 5:
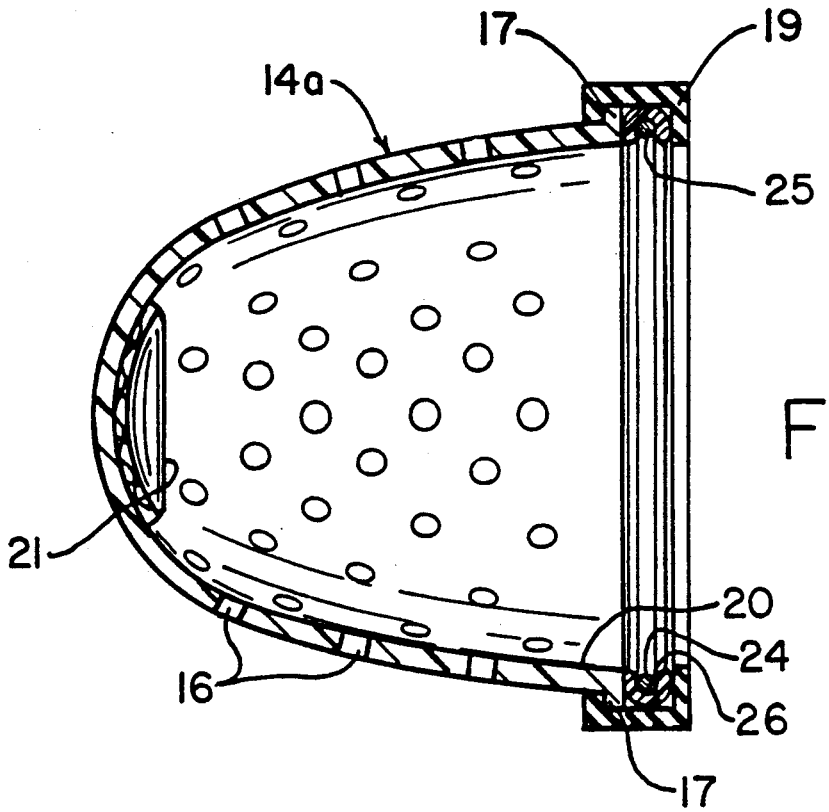
FIG. 5 is an orthographic cross-sectional illustration of a modified breast cup structure.
Figure 6:
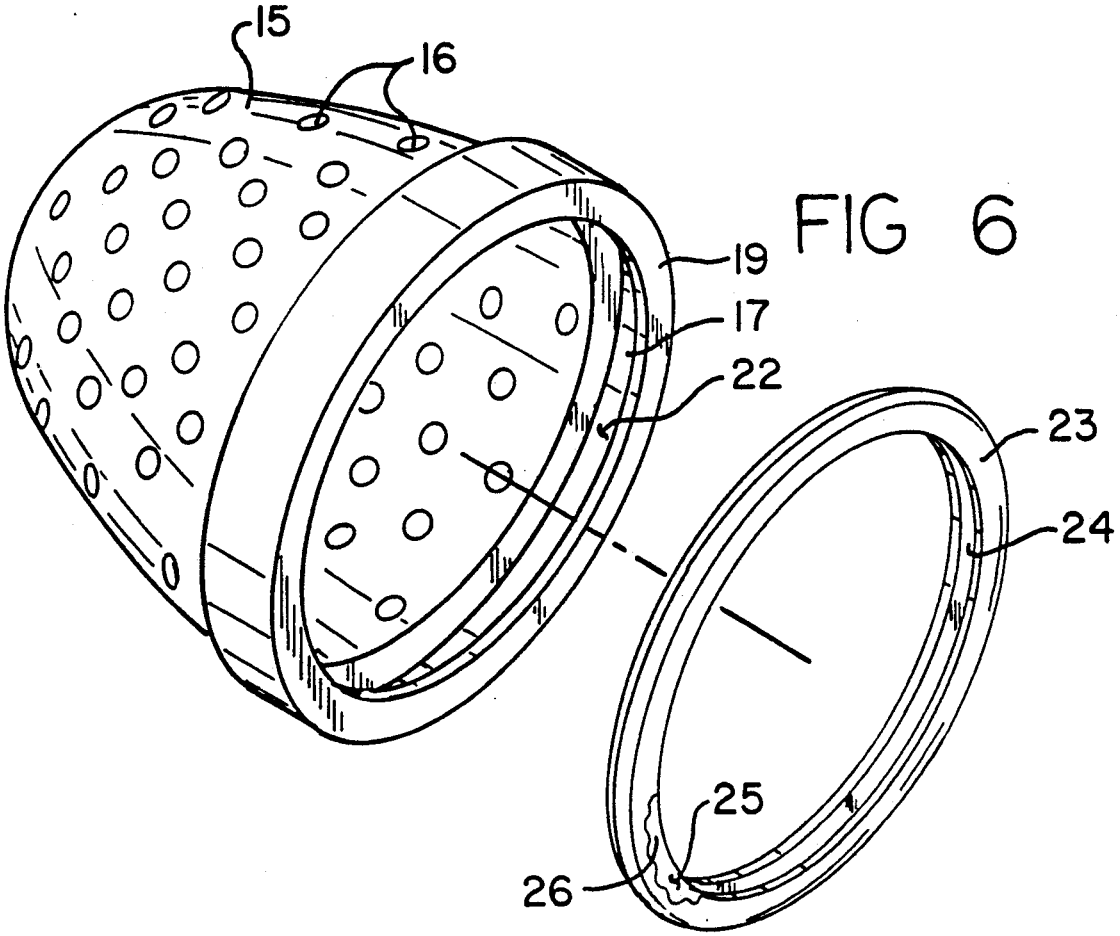
FIG. 6 is an isometric illustration, partially in exploded view, to indicate the cushion member arranged for insertion within the cushion member trough.

The FIG. 5 and FIG. 6 indicates a modified cup construction 14*a* having an annular cushion member trough 22 directed into the cushion member 19 to permit reception of a resilient annular ring 23. The annular ring 23 is complementarily received within the annular cushion member trough 22. The annular ring 23 includes an annular frangible cover 24 concentrically mounted relative to the annular ring 23 positioned over the ring trough 26 of the ring 23 containing a fluid skin lotion 25 therewithin. In this manner, upon excessive compression directed to the cushion member 19, the ring 23 formed of a resilient material is compressed effecting rupture of the frangible cover 24 projecting a fluid lotion 25 thereabout to afford protection relative to the engagement of the cushion member 29 with the skin portion of the individual's torso in surrounding relationship relative to that individual's breast.

Figure 7:
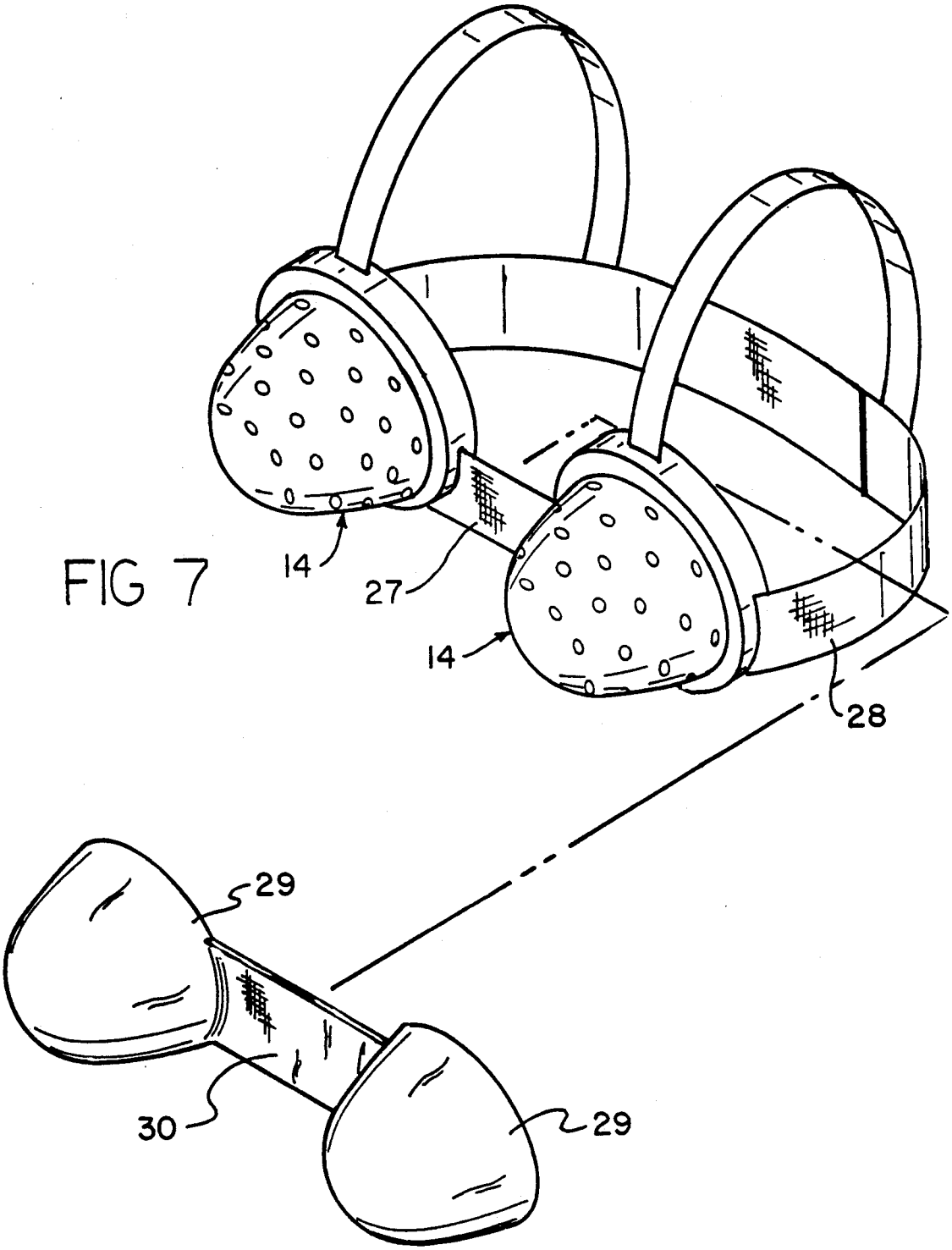
FIG. 7 is an isometric illustration of the invention employing cup insert members in a brassiere structure.

The FIG. 7 indicates a plurality of the breast cups 14 having a breast cup connecting web 27 directed therebetween of a predetermined length, with a securement strap 28 extending relative to the breast cups for securement about an individual's torso, with spaced breast cup resilient insert cups 29 arranged for positioning and projection within the breast cups 14, with the insert cups 29 having a cup web 30 therebetween, wherein the cup web is of a length substantially equal to the predetermined length to maintain positioning of the insert cups 29 within the breast cups 14 or 14*a*, as utilized within the construction of the FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective breast cup arrangement, comprising, a brassiere member having a plurality of resilient cup members, and each cup member receives a breast cup therewithin, each breast cup including a rigid cup member having a matrix of apertures directed therethrough, and each breast cup member including a cup annular rim, with each of the breast cups symmetrically oriented about a cup axis, and the annular rim orthogonally oriented relative to the cup axis projecting laterally of the breast cup, wherein a continuous cushion member is mounted coextensively to the annular rim, and each breast cup includes an interior wall surface, and each interior wall surface includes a nipple pad mounted fixedly to the interior wall surface symmetrically oriented relative to the cup axis spaced from the annular rim, wherein each nipple pad is formed of a lotion impregnated fluid absorbent sponge material, and the cushion member includes a cushion member trough continuously directed into the cushion member, and a resilient annular ring complementarily received within the cushion member trough, the annular ring includes a ring trough coextensively directed into the annular ring, with the ring trough having a fluid lotion therewithin, and an annular frangible cover extending over the ring trough permitting rupture of the frangible cover upon impact to the cushion member.

2. An arrangement as set forth in claim 1 wherein the breast cups include a connecting web directed therebetween, wherein the connecting web has a predetermined length, and a plurality of breast cup resilient insert cups, wherein each of said insert cups is arranged for reception within one of said breast cups, and the insert cups include an insert cup web directed therebetween, wherein the insert cup web is of a web length substantially equal to the predetermined length.

* * * * *